US012576306B2

(12) United States Patent
Benjamin et al.

(10) Patent No.: US 12,576,306 B2
(45) Date of Patent: Mar. 17, 2026

(54) EXERCISE DEVICE

(71) Applicants: Greca Benjamin, Randolph, MA (US); Clint Benjamin, Randolph, MA (US); Krystle Liles, Bridgewater, MA (US); Roy S. Meade, Port Richey, FL (US)

(72) Inventors: Greca Benjamin, Randolph, MA (US); Clint Benjamin, Randolph, MA (US); Krystle Liles, Bridgewater, MA (US); Roy S. Meade, Port Richey, FL (US)

( * ) Notice: Subject to any disclaimer, the term of this patent is extended or adjusted under 35 U.S.C. 154(b) by 68 days.

(21) Appl. No.: 18/639,391

(22) Filed: Apr. 18, 2024

(65) Prior Publication Data

US 2024/0350862 A1 Oct. 24, 2024

Related U.S. Application Data

(60) Provisional application No. 63/496,737, filed on Apr. 18, 2023.

(51) Int. Cl.

| | |
|---|---|
| ***A63B 23/03*** | (2006.01) |
| ***A63B 21/00*** | (2006.01) |
| ***A63B 21/065*** | (2006.01) |
| ***A63B 21/072*** | (2006.01) |

(52) U.S. Cl.

CPC ..... *A63B 23/032* (2013.01); *A63B 21/065* (2013.01); *A63B 21/0726* (2013.01); *A63B 21/151* (2013.01); *A63B 2225/09* (2013.01)

(58) Field of Classification Search

CPC . A63B 21/065; A63B 21/072; A63B 21/0722; A63B 21/0724; A63B 21/0726; A63B 21/0728; A63B 21/075; A63B 23/032

See application file for complete search history.

(56) References Cited

U.S. PATENT DOCUMENTS

| | | | | |
|---|---|---|---|---|
| 4,744,556 | A | 5/1988 | Shaffer | |
| 5,336,138 | A | 8/1994 | Arjawat | |
| 5,431,610 | A | 7/1995 | Miller | |
| 5,484,359 | A | 1/1996 | Wabafiyebazu | |
| 5,501,646 | A | 3/1996 | Miller | |
| 5,662,554 | A * | 9/1997 | Schaefer | A63B 21/4003 482/10 |
| 6,494,818 | B1 * | 12/2002 | Richmond | A63B 21/0552 482/121 |
| 7,238,144 | B2 | 7/2007 | Ferrara | |
| 7,854,695 | B2 | 12/2010 | Lightbourne | |
| 8,979,716 | B1 * | 3/2015 | Rawlins | A63B 21/4043 482/129 |
| 9,198,820 | B2 | 12/2015 | Philipson | |
| 9,526,944 | B2 | 12/2016 | Knies | |

(Continued)

*Primary Examiner* — Zachary T Moore

(74) *Attorney, Agent, or Firm* — Dunlap Bennett & Ludwig PLLC

(57) ABSTRACT

A multifunctional mouthpiece exercise device is provided. The mouthpiece-based exercise device provides a cord terminating at each end with a loop portion, a mouthpiece movable along the cord, two weight fasteners for cinching a weight in both loop portions, and two adjustment sets adapted to selectively set a distance between the mouthpiece and each of the loop portions. The mouthpiece is dimensioned and shaped to fit the mouth and along the neck and the shoulders of a user so they can perform at least three exercise routines for their face, neck, and shoulders, respectively.

13 Claims, 3 Drawing Sheets

(56) References Cited

U.S. PATENT DOCUMENTS

| | | | | |
|---|---|---|---|---|
| 9,707,428 | B1 * | 7/2017 | Mitalski | A63B 21/068 |
| 9,775,764 | B1 * | 10/2017 | Rill | A61H 1/0266 |
| 10,238,909 | B1 | 3/2019 | Teeman | |
| D872,200 | S * | 1/2020 | Antezana | D21/692 |
| 10,549,151 | B2 | 2/2020 | McGhee | |
| 2005/0043154 | A1 | 2/2005 | Atrizadeh | |
| 2013/0053225 | A1 | 2/2013 | Meyer | |
| 2015/0024908 | A1 * | 1/2015 | Hall | A63B 21/0722 482/93 |
| 2017/0239516 | A1 | 8/2017 | Lee | |
| 2018/0008859 | A1 * | 1/2018 | Cook | A63B 71/0622 |
| 2022/0126152 | A1 * | 4/2022 | Holmes | A63B 23/025 |

* cited by examiner

EXERCISE DEVICE

CROSS-REFERENCE TO RELATED APPLICATION

This application claims the benefit of priority of U.S. provisional application No. 63/496,737, filed 18 Apr. 2023, the contents of which are herein incorporated by reference.

BACKGROUND OF THE INVENTION

The present invention relates to exercise devices and, more particularly, a multifunctional exercise device for exercising and toning the facial, shoulder, back and abdominal muscles.

Current exercise devices for exercising and toning the facial, shoulder, back and abdominal muscles that utilize a mouthpiece are difficult to fit in the user's mouth. While the mouthpiece-based exercise equipment is easy replicated and seems simple to use, one does not achieve the desired results in a reasonable time because of lack of adjustability of the mouthpiece. As a result, users cannot tailor the workout to their needs and desires. Which in turn has users feeling it takes too long to see appreciable results and when they do see results, they are deemed nominal.

In other words, current mouthpiece-based exercise devices do not work well because they do not fit your mouth properly and the resistance can be too high or not high enough to produce the desired results with a reasonable time frame, and these prior art solutions do not provide selective adjustability the mouthpiece fit and weighted resistance.

As can be seen, there is a need for a multifunctional exercise device for exercising and toning the facial, shoulder, back and abdominal muscles, wherein the multifunctional exercise device embodies a selectively adjustable mouthpiece.

SUMMARY OF THE INVENTION

The mouthpiece of the present in invention is dimensioned and adapted to fit the mouth comfortably and so that the user can selectively adjust the resistance and weight level. Accordingly, users can selectively adjust the weight depending from the mouthpiece in accordance to their body's response to it being loaded and their fitness goals. This selectively enables improvement in appreciably developing facial tone, and as a result lessening wrinkles due to stronger and toner muscles and increase in associated muscle mass. As a result, the present invention affords a great sense of wellness within an accomplishable and reasonable time after usage.

Daily usage of the present invention solves sagging skin and wrinkle problems, as well as lack of muscle tone and loss of strength in facial, jaw, and neck muscles. The present invention can also be used to strengthen weak shoulders, back, and abdominal muscles that leads to overall feelings of un-wellness or inadequacy.

The present invention is an improvement because it is one device functioning to improve multiple musculoskeletal systems not only the overall facial musculature but also the user's shoulders, back and abdominal muscles.

The present invention is an improvement over the prior art because it targets all user facial muscles the same way arm exercises target the arm muscles and is an improvement because it has multiple usages including facial, neck, jaw, shoulders, back and abdominal muscles.

The device embodied in the present invention increases muscle tone in the user's overall face, neck, jaw, shoulders, back and abdominal muscles. Other devices are not multifaceted nor have multiple functionalities but instead only target one area of the body while the present invention targets multiple musculoskeletal systems and yields great results. Other devices require the user to purchase other devices to target non-facial muscles and those devices take longer to achieve desired results leaving the users dissatisfied with their outcome. Furthermore, other devices are not comfortable to use and may only target a particular facial muscle with nominal results, wherein the present invention targets multiple body systems within the musculoskeletal system and produces impressive results.

Moreover, the mouthpiece is very soft so that even an infant would not be harmed by having it place it its mouth.

In one aspect of the present invention, a mouthpiece-based exercise device, the mouthpiece-based exercise device includes the following: a cord terminating at each end with a loop portion; a mouthpiece movable along the cord; two weight fasteners, one weight fastener adjacent each loop portion, wherein each weight fastener is configured to selectively define an area defined by the loop portion; and two adjustment sets, one adjustment set between each loop portion and the mouthpiece, wherein each adjustment set is configured to selectively set a distance between the mouthpiece and the loop portions.

In another aspect of the present invention, the mouthpiece-based exercise device further includes a dumbbell weight received in both loop portions so that the mouthpiece-based exercise device defines a necklace shape, wherein the weight fastener is a slider that cinches the loop portion, wherein the weight fastener is a clip that cinches the loop portion or wherein each adjustment set comprises a plurality of slide stop knots and a slider that is movable along the cord, wherein the mouthpiece is gel; further including a positioning knot on each end of the mouthpiece, whereby the positioning knots selectively fix a position of the mouthpiece along the cord.

In yet another aspect of the present invention, a method of performing at least three exercises, a facial exercise, a neck exercise, and a shoulder exercise, using a single mouthpiece-based exercise device includes providing the above-mentioned mouthpiece-based exercise device and performing each of the facial exercise, the neck exercise, and the shoulder exercise wherein the mouthpiece engages a mouth, a neck, and a shoulder of an exerciser.

It is understood that the weight be limited only to a dumbbell; rather any weight that can span the two loop portions would work.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Figure 1:
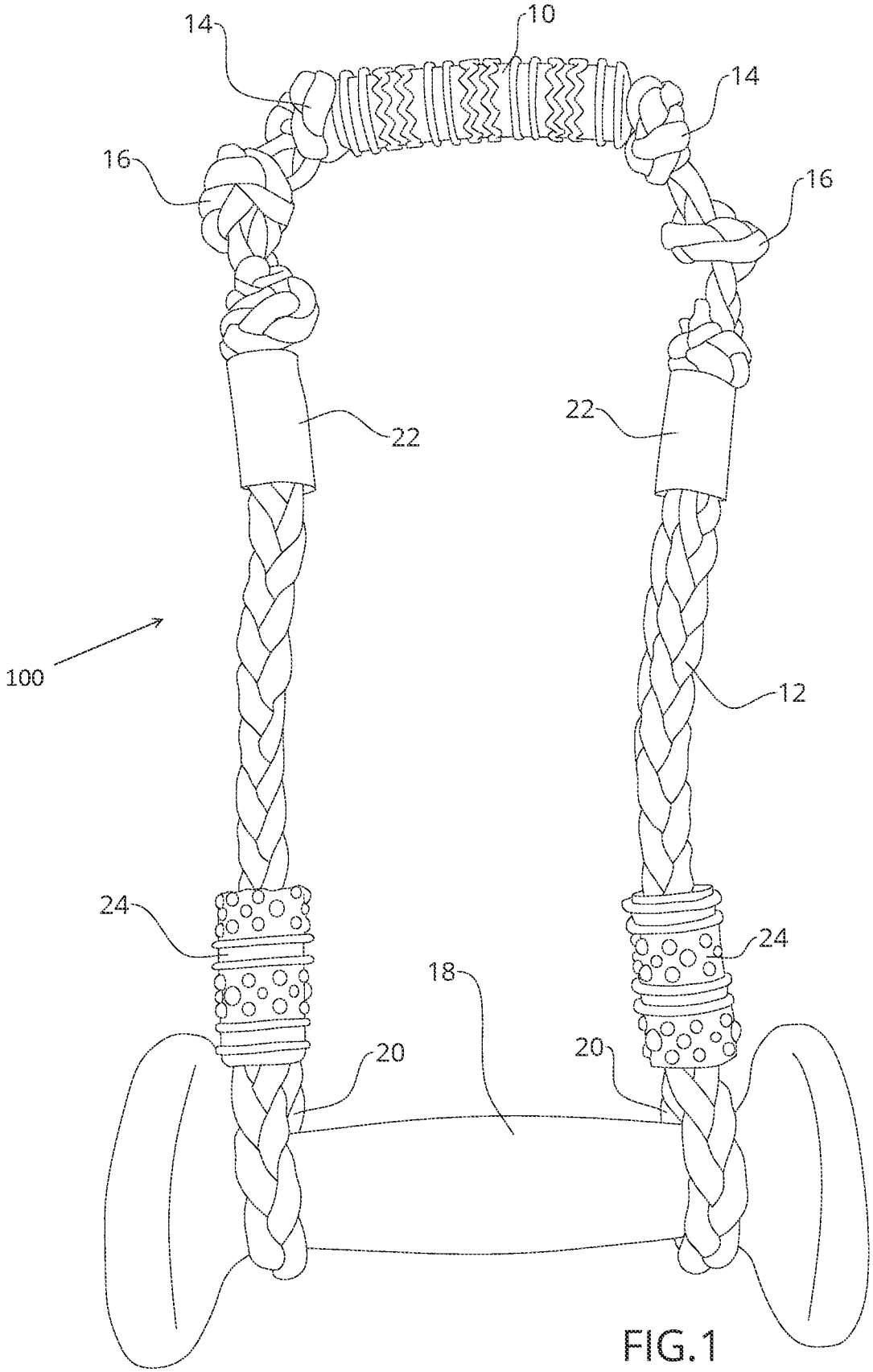
FIG. 1 is a perspective view of an exemplary embodiment of the present invention.
Figure 2:
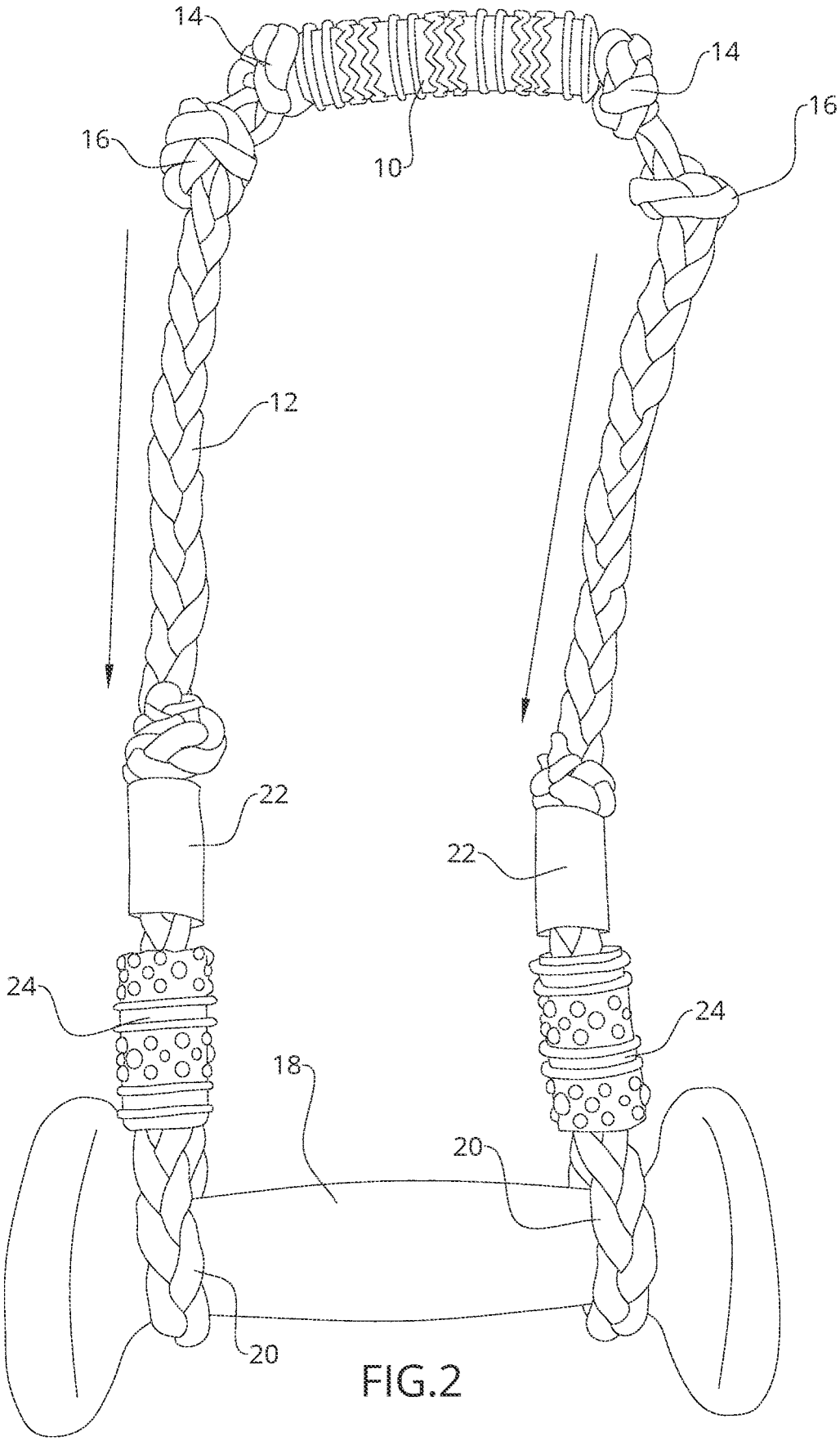
FIG. 2 is a perspective view of an exemplary embodiment of the present invention, illustrating the adjustability of the distance between the mouthpiece 10 and the resistance-inducing weight 18.
Figure 3:
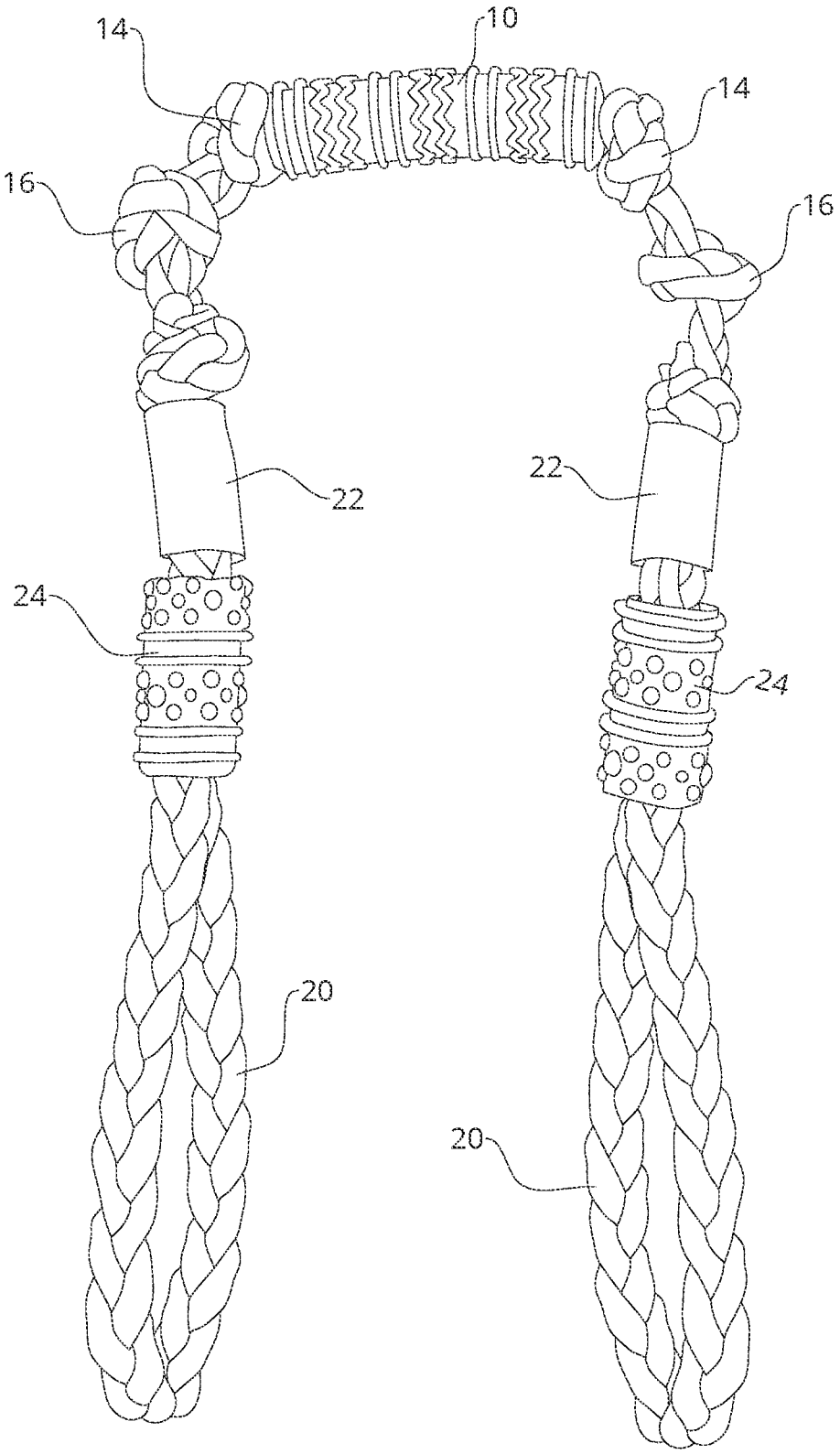
FIG. 3 is a perspective view of an exemplary embodiment of the present invention.

Referring now to FIGS. 1 through 3, the present invention may include a multifunctional exercise device 100 having a mouthpiece 10 operatively associated with a weight 18 by way of a durable cord 12 while the mouthpiece 10 is engaged by the mouth of the user. The durable cord 12 may comprise three-strands of braided paracord. The mouthpiece 10 is adapted to be received by the mouth of a user and held in place between the user's jaws. The mouthpiece 10 may be made from a soft gel. The mouthpiece 10 may be relatively fixed along the cord 12 by way of two positioning knots 14 that bookend the mouthpiece. In one embodiment, the mouthpiece is a tubular element where the cord 12 is received through the lumen of the tubular element, whereby the mouthpiece is selectively slidably along the cord 12. The positioning knots 14 fix the mouthpiece 10 along the cord 12. The positioning knots 14 may be removed if the user wants to replace the mouthpiece 10 (say with one sized and dimensioned for another user). In other embodiments, the mouthpiece 10 may be integrated with the cord 12 so that the cord 12 extends from both ends thereof. In other embodiments, The cord 12 may end in loops 20 for removably connecting to both ends of the weight 18 received therein, respectively. The weight 18 may conveniently be dumbbell shape, like that of a hand weight as illustrated in the Figures, wherein the ends of the weight 18 are flared so that the ends have a substantially greater diameter than the middle portion of the weight 18, whereby the weight 18 does not slip out of the loops 20.

A foldable clip fastener or weight sliders 24 may be provided to selectively adjust and fix the loop portions 20 that accommodates the weight 18. Each loop portion may be dimensioned to receive many different sized weights 18 (or multiple weights 18), and so the foldable clip fastener or weight sliders 24 slide over an unused portion of the loop portion 20 to cinch the loop portion so that the weight(s) 18 are not moving around. Likewise a clip fastener can selectively set the openness of the loop portion 20 for securing a certain weight 18 therein.

Along the cord 12 may be one or more slide stop knots 16 and a slider 22 between the distalmost (relative the mouthpiece 10) and the weight sliders 24. The combination of the slide stop knots 16 and slider 24 enable the distance between the mouthpiece 10 and the weight 18 to be selectively adjusted, with each side of the cord 12 (between the mouthpiece 19 and the weight 18) being independently so adjustable. This enables a user to adjust such distance for different exercise routines where one targets the shoulders, another is tailored for neck, and yet another targets the facial muscles—as described in more detail below—and thus make the exercise device "multifunctional".

An adjustable spring cord lock/end stopper fastener slider for adding or changing additional weight may be provided.

The mouthpiece 10, cord 12, and weights 18 are adapted to enable up and down neck and jaw movements during exercise. The mouthpiece 10 can be used for exercising user's shoulder muscles by placing the device on user's shoulders while taking a walk or in a seated position with up and down movement toward the neck and head. Another function of the multifunctional exercise device 100 includes exercising the shoulders and muscles using the dual-function mouthpiece 10 as a shoulder rest on the user's shoulder.

The multifunctional exercise device 100 may be used for the shoulder muscles for exercising the shoulders and neck muscles. The mouthpiece 10 is placed on the user's shoulders while walking or in a seated position raising the user's shoulders up towards the neck/face releasing and repeating the up and down motion of the shoulders. The resistance exercise of up and down motion of the shoulders, when using the device properly will cause the muscles in the shoulders and neck to become firm, toned, and well-conditioned, thus, strengthening the shoulders and neck muscles, reducing fatty built up.

A multi-function exercise device for use of exercising the cervical, thoracic, lumbar spine and the abdominal muscles by using the multifunctional mouthpiece to be placed around the user's neck. The multifunctional exercise device 100 may be used in an erect upward standing position, bend and lowering the back at a 45-degree to 90-degree angle and raising back up to an erect position and repeating up and down motion.

The resistance weight bearing exercise that includes bending by the back with up-down motion, when using the device properly will cause the muscles in the back to become firm, toned, and well-conditioned, thus, strengthening the back muscles and reducing fatty built up.

The multifunctional exercise device 100 may be used for exercising the face, neck, and jaw by introducing a mouthpiece in the mouth over the upper and lower jaw and teeth. The mouthpiece introduces a cord that has a resistance adjustable bar bell weight. The user will exercise their lower jaw by urging up and down motion of the jaw to exercise the neck, face, and jaw muscles. The user would then exercise the lower jaw by opening and closing of the lower jaw to exercise the neck, facial muscles, and jaw. The resistance exercise of up and down motion of the jaw, when using the device properly, will cause the muscles in the jaw, neck, and face to become firm, toned, and well-conditioned, thus, reducing sagging of the skin, fatness built up under the chin, and control excessive wrinkling of the face.

In addition, the device may also be used for the shoulder's exercises and the neck muscles, wherein the entire device is placed over the user's shoulders with the multifunctional mouthpiece resting on the shoulders while the device hangs like a shoulder bag. When the user is walking or in a seated position and by raising the user's shoulders up towards the neck/face releasing and repeating the up and down motion of the shoulders lends itself to an increase in muscle tone and mass. The user may adjust the weight of the device by adding heavier weight to the device. The resistance exercise of up and down motion of the shoulder muscles, when using the device properly will cause the muscles in the shoulders and neck to become firm, toned, and well-conditioned, thus, strengthening the shoulders and neck muscles, reducing fatty built up in the tissues and a saggy neck.

Additionally, the device is used to exercise the cervical, thoracic, lumbar spine and abdominal muscles. The multifunctional mouthpiece is placed around the user's neck and the cord and weight hangs like a necklace around the user's neck, and whilst in the standing position, the user bends their back to a 90-degree angle or less along with continuing down and up motions. The resistance weight bearing exercises bending the back while wearing the device and adding weight to the device as the user's see proper with up-down motion of the back. When using the device properly will cause the muscles abdominal and back muscles to become firm, toned, and well-conditioned, thus, strengthening the back muscles and reducing fatty built up.

To make the invention a manufacturer may need a rubber mouthpiece; paracord with a single braid; weights and foldable clips. Some additional accessories include two colorful 1-inch rubbers in the mid-section of the cord where the clips meet to form a seal.

The mouthpiece can be interchangeable or even reconfigured, but performance would remain the same. The two colorful approximately 1-inch rubbers in the mid-section can be shuffled or interchanged but would cause the invention to perform in an identical or similar function.

Using the present invention may result in the following:

(a) increase facial muscles tone by placing the device mouthpiece into the user's mouth and opening and closing ones mouth with a hanging weight of 1-5 lbs. 4 repetitions daily;

(b) increase jaw firmness and good muscle tone by placing the mouthpiece in the user's mouth and lowering and opening the jaw with 4 sets of the same repetition on a daily basis would tone and strengthen the jaw muscles;

(c) increase neck firmness and strong muscle tone by placing the device mouthpiece in the user's mouth and opening and closing the mouth multiple sets a day, thereby increase muscle tone and strengthen the neck muscles;

(d) increase overall facial blood flow, thus promoting a strong and healthy appearance by placing the mouthpiece in the user's mouth and opening and closing the mouth would increase blood flow to the facial muscles;

(e) increase shoulder muscle and good tone by a user placing their arm through the cord and lifting their shoulders up and down while walking or in a seated position would increase muscle tone and strengthen the shoulders;

(f) increase back muscle and tone by placing the cord over the head while standing in an erect position, bend downward at a 45-to-90-degree angle followed by raising back up to an erect position with 4 sets daily will increase strength of your back muscles and good posture and good muscle tone;

(g) increase abdominal muscle tone by using the device while standing erect and having the device placed over the user's head; bending the back downward at a 45-to-90-degree angle 4 sets daily would build and strengthen the user's abdominal muscles leading to good posture;

(h) decrease sagging skin from the neck and weak muscles through placing the mouthpiece section in the mouth and letting the weight hang then open and close the mouth repeated on a daily basis, whereby the muscle under the skin will become firm leading to a more youthful appearance;

(i) decrease jaw sagging skin by using the device; place the mouthpiece section in the mouth and let the weight hang then open and close the mouth and repeat with multiple daily sets, whereby the jaw muscle would become firm, and it would improve your profile;

(j) decrease wrinkles in the face, neck, and jaws by placing the mouthpiece section in the mouth and let the weight hang then open and close the mouth and repeat with multiple daily sets, whereby the facial, neck and jaw muscle would strengthen, become tone leading to a more youthful appearance; and (k) decrease abdominal belly fat by placing the device over the head and let the weight hang, then bend your back to 45 to 90-degree angle and come back to an erect position and repeat, thereby increasing abdominal muscles, thus leading to better posture and a strong core.

Additionally, the present invention could be repurposed for some other usage like house pets that may have gained some weight and need to do more muscle training exercise. They can wear weights around their necks and the pet would be exercising daily without realizing they are exercising. The cord of the present invention could also be used as a jumping rope for exercise.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A mouthpiece-based exercise device, the mouthpiece-based exercise device comprising:

a cord terminating at each end with a loop portion;

a mouthpiece movable along the cord;

two weight fasteners, one weight fastener adjacent each loop portion, wherein each weight fastener is configured to selectively define an area defined by the loop portion; and two adjustment sets, one adjustment set between each loop portion and the mouthpiece, wherein each adjustment set is configured to selectively set a distance between the mouthpiece and the loop portions, wherein each adjustment set comprises a plurality of slide stop knots and a slider that is movable along the cord.

2. The mouthpiece-based exercise device of claim 1, further comprising a dumbbell weight received in both loop portions so that the mouthpiece-based exercise device defines a necklace shape.

3. The mouthpiece-based exercise device of claim 1, wherein the weight fastener is a slider that cinches the loop portion.

4. The mouthpiece-based exercise device of claim 1, wherein the weight fastener is a clip that cinches the loop portion.

5. The mouthpiece-based exercise device of claim 1, wherein the mouthpiece is gel.

6. The mouthpiece-based exercise device of claim 1, further comprising a positioning knot on each end of the mouthpiece, whereby the positioning knots selectively fix a position of the mouthpiece along the cord.

7. A mouthpiece-based exercise device, the mouthpiece-based exercise device comprising:

a cord terminating at each end with a loop portion;

a mouthpiece movable along the cord;

two adjustment sets, each adjustment set comprising a plurality of slide stop knots and a slider that is movable along the cord, one adjustment set between each loop portion and the mouthpiece, wherein each adjustment set is configured to selectively set a distance between the mouthpiece and the loop portions;

a dumbbell weight received in both loop portions so that the mouthpiece- based exercise device defines a necklace shape;

two weight fasteners, one weight fastener slider adjacent each loop portion, wherein each weight fastener slider is configured to selectively define an area defined by the loop portion for locking the dumbbell weight therein; and a positioning knot on each end of the mouthpiece, whereby the positioning knots selectively fix a position of the mouthpiece along the cord.

8. A method of performing at least three exercises, a facial exercise, a neck exercise, and a shoulder exercise, using a single mouthpiece-based exercise device, the method comprising:

providing the mouthpiece-based exercise device of claim 7; and performing each of the facial exercise, the neck exercise, and the shoulder exercise wherein the mouthpiece engages a mouth, a neck, and a shoulder of an exerciser, respectively.

9. A mouthpiece-based exercise device, the mouthpiece-based exercise device comprising:

a cord terminating at each end with a loop portion;

a mouthpiece movable along the cord;

two weight fasteners, one weight fastener adjacent each loop portion, wherein each weight fastener is configured to selectively define an area defined by the loop portion;

two adjustment sets, one adjustment set between each loop portion and the mouthpiece, wherein each adjustment set is configured to selectively set a distance between the mouthpiece and the loop portions; and a positioning knot on each end of the mouthpiece, whereby the positioning knots selectively fix a position of the mouthpiece along the cord.

10. The mouthpiece-based exercise device of claim 9, further comprising a dumbbell weight received in both loop portions so that the mouthpiece-based exercise device defines a necklace shape.

11. The mouthpiece-based exercise device of claim 9, wherein the weight fastener is a slider that cinches the loop portion.

12. The mouthpiece-based exercise device of claim 9, wherein the weight fastener is a clip that cinches the loop portion.

13. The mouthpiece-based exercise device of claim 9, wherein the mouthpiece is gel.

* * * * *